United States Patent [19]

Detwiler

[11] 4,271,976

[45] Jun. 9, 1981

[54] COMBINATION PRESSURE RELEASE COOLING CAP AND RECOVERY OF COOLANT

[75] Inventor: Timothy Detwiler, Dixon, Ill.

[73] Assignee: E. Edelmann & Co., Skokie, Ill.

[21] Appl. No.: 93,453

[22] Filed: Nov. 13, 1979

[51] Int. Cl.[3] ..... B65D 51/16

[52] U.S. Cl. ..... 220/206; 220/DIG. 32

[58] Field of Search ..... 220/203, 206, 303, 231, 220/293, 298, DIG. 32, 304, 295; 277/102, 103

[56] References Cited

U.S. PATENT DOCUMENTS

| | | | |
|---|---|---|---|
| 2,406,502 | 8/1946 | Lines | 220/203 |
| 2,528,791 | 11/1950 | Scovile | 220/206 X |
| 2,968,421 | 1/1961 | Eshbaugh | 220/303 X |
| 3,004,783 | 10/1961 | Webb | 277/103 |
| 3,074,588 | 1/1963 | Burdue | 220/231 |
| 3,186,580 | 6/1965 | Preuite | 220/206 |
| 3,373,894 | 3/1968 | Johnson | 220/303 X |
| 3,830,398 | 8/1974 | Shanklin | 220/202 |

*Primary Examiner*—Allan N. Shoap
*Attorney, Agent, or Firm*—Norman Lettvin

[57] ABSTRACT

A radiator cap is provided with safety venting character for use with a coolant recovery system. The cap is provided with lever means which compel safety venting of excess pressure in the radiator before the cap can be removed, the venting being effected automatically through a selectively movable valve that is moved to an open position by actuation of the lever means. The cap serves as part of a coolant recovery system, with the selectively movable valve also serving as the valve that automatically opens to permit siphoning of coolant back into the radiator during the cool-down portion of the coolant's heating and cooling cycle.

5 Claims, 3 Drawing Figures

FIG. 1
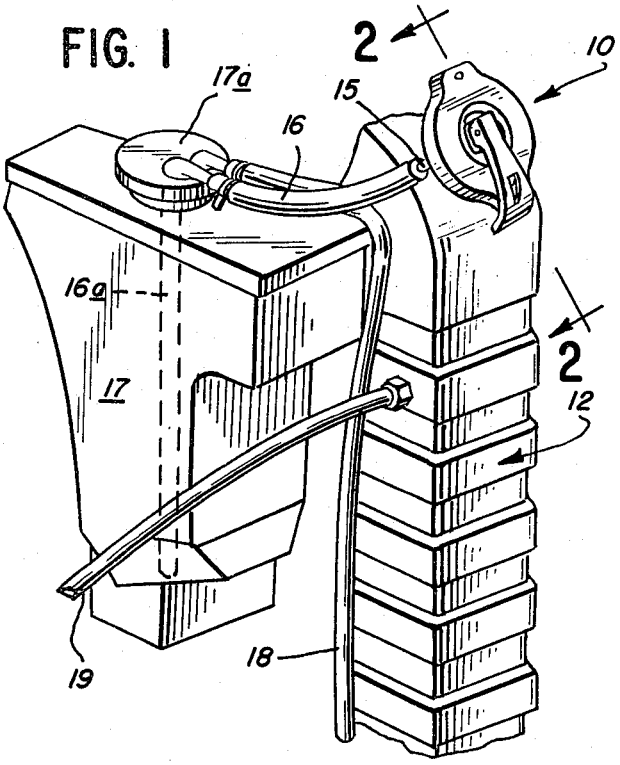
FIG. 3
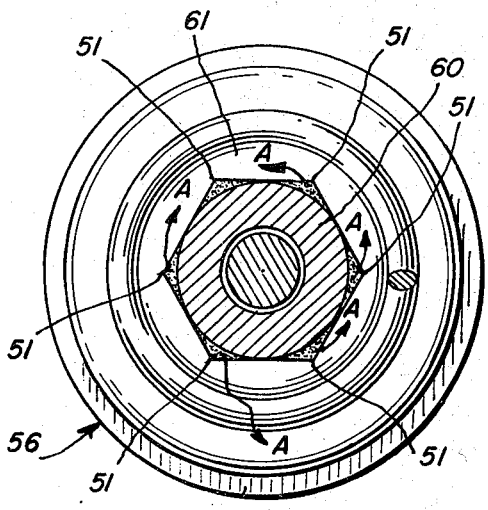
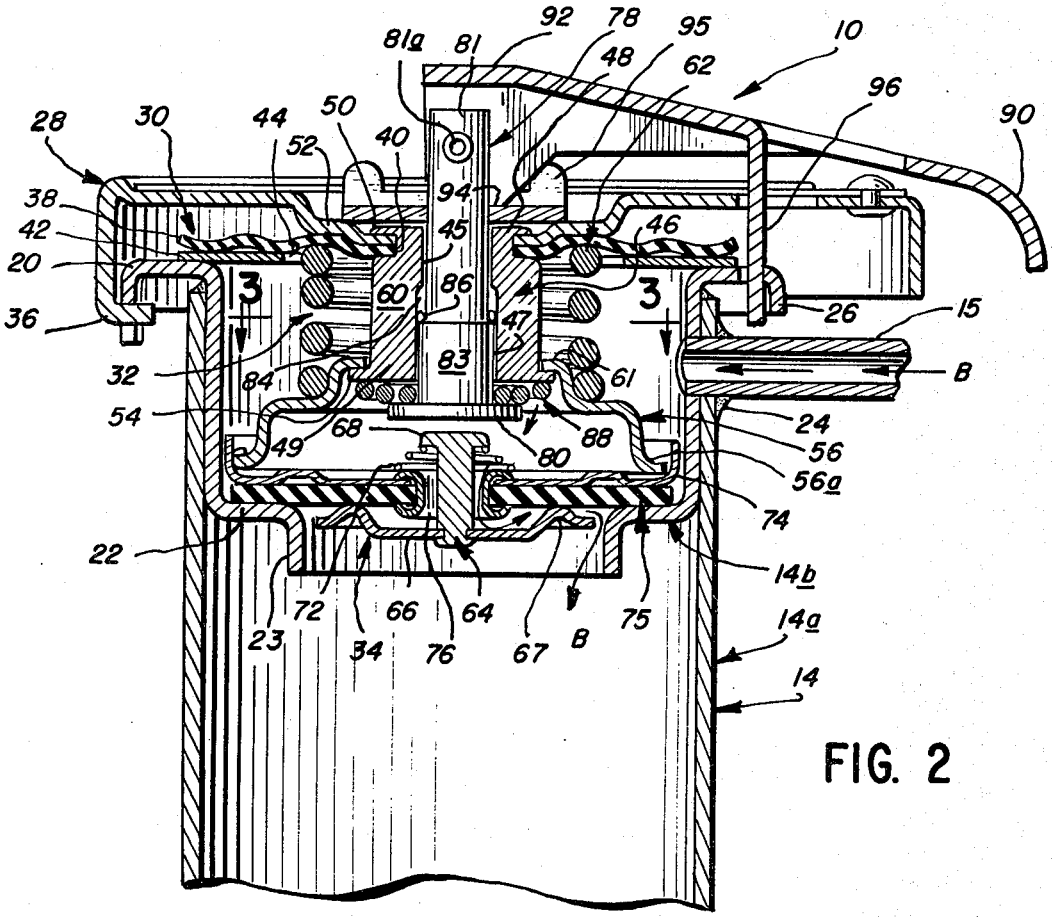
FIG. 2

COMBINATION PRESSURE RELEASE COOLING CAP AND RECOVERY OF COOLANT

BACKGROUND OF THE INVENTION

Radiator caps for automobiles are known which are equipped with spaced members for seating against upstream and downstream seats provided on the filler neck of the radiator, with the lower member normally biased so as to effect a sealing force against the downstream seat, to seal the radiator and to cause the radiator to function at a selected design pressure above atmospheric pressure. When pressure in the radiator exceeds the selected design pressure, the lower seal member unseats to permit escape of pressurized gas and liquid and to avoid damage to the system. However, since some pressure is retained in the radiator, and since sudden release of the design pressure could itself be dangerous, it has been known to provide such a cap with means that compel release of all radiator pressure above atmospheric pressure before the cap can be removed from the radiator filler neck. In one such construction the lower member is provided with a vent valve that is selectively openable to release excess pressure, and is automatically openable to relieve a vacuum in the radiator. In another such construction, selective release of excess pressure is achieved by lifting the entire lower valve.

It is also known to provide a coolant recovery system for automotive radiators wherein the cap therefor includes a lower seal disc that is normally spring biased against the lower seat of a radiator's filler neck, such that as the raditor's coolant expands it operates to lift the lower seal disc to permit expanded coolant liquid to flow from the radiator to a coolant recovery container, and to then siphon back to the radiator upon the radiator cooling. The cap for such a system does not have means for selectively and safely venting excess pressure from the radiator. Thus, in coolant recovery systems, removal of a radiator cap before pressure in the radiator has been safely reduced, has led to hand burns; the alternative being substantial time delay in waiting for the radiator's contents to cool to a safe temperature.

Heretofore, no cap for a coolant recovery system has been provided with a safety venting valve feature which precludes removal of the cap until after radiator pressure had been released, and which also provides utility in the coolant recovery system permitting expanded coolant to flow to a coolant recovery container and providing for siphonage of coolant through the safety venting valve of the cap from the recovery container to the radiator upon cooling of the radiator.

It is desirable that a radiator cap prevent loss of radiator coolant liquid. However, wherever there exists a movable part that is required to act freely and easily in the presence of pressurized liquid, there always exists the possibility of undesirable leakage of liquid through the channels defined between moving parts.

Thus, one object of this invention is to provide a radiator cap for a coolant recovery system that provides both a safety venting feature which precludes removal of said cap until radiator pressure has been first vented to the coolant recovery reservoir and which also provides utility in the coolant recovery system, permitting passage of expanded coolant therepast to a coolant recovery container and which provides for siphonage of coolant from the recovery container through a portion of said radiator cap back into the radiator without loss of coolant past the cap.

Another object of this invention is to provide a multiple purpose radiator cap with a selectively movable stem for actuating a vent valve in the cap and with means to permit ready action of the movable stem while limiting leakage of pressurized liquid, and atmospheric air when siphoning, therethrough.

Further objects and advantages will become apparent to one skilled in the art from the following description of a preferred embodiment of the invention.

SUMMARY OF THE INVENTION

The improved cap of the present invention is adapted for use with an automotive vehicle equipped with a coolant recovery system wherein temperature-expanded coolant moves under pressure from the radiator to a coolant-capturing reservoir and upon cooling the coolant is siphoned back from the reservoir to the radiator. The radiator has a filler neck which has thereon an upstream seat and an adjacent camming flange, and also a downstream seat past which temperature-expanded coolant will pass. The filler neck between said upstream and downstream seats, connects through a tube to a coolant-capturing reservoir.

The radiator cap includes: a cap head shaped to cooperate with a filler neck for manual twist-on connection to the filler neck; an upstream spring disc for cooperation with the filler neck's terminus to bias the cap head away from said terminus of the neck; an annular resilient seal, or gasket, positioned between the spring disc and filler neck's terminus to provide a seal against liquid and air leakage therepast; an elongated annular body secured at its upper end to the cap head and with an out-turned flange at its lower end, a downstream valve mounted to be axially movable relative to the elongated body; spring means biasing the downstream valve away from the cap head; the downstream valve including a vent valve member that is spring biased upstream; a vent pin arranged for reciprocation through the annular body and positioned to selectively depress the vent valve when moved downstream; a lever for selectively moving the vent pin; a frusto-conical spring between the annular body and vent pin biasing the vent pin downstream; constricted passageway sections between the vent pin and elongated body, separated by an axially elongated pocket in which the O-ring rolls, said constricted passageway sections serving to capture the O-ring in the pocket where the necessary seal is effected; and an O-ring seal upstream of said constricted passageway to prevent loss of liquid and air, or vapor, therethrough.

BRIEF DESCRIPTION OF THE DRAWINGS

FIG. 1 is a perspective view of the radiator cap of the present invention, illustrating the cap operatively attached to a radiator and illustrating the cap's communication with a coolant-capturing reservoir, the same comprising a coolant recovery system for an automotive vehicle;

FIG. 2 is an enlarged axial cross-sectional view of the radiator cap shown operatively positioned on the upper-end of a radiator filler neck and taken substantially along line 2—2 of FIG. 1; and FIG. 3 is a cross-sectional view taken substantially on line 3—3 of FIG. 2.

DETAILED DESCRIPTION OF THE INVENTION

Referring now to the drawings and specifically to FIGS. 1 and 2, the improved radiator cap is shown at 10. Although cap 10 could be used merely as a vented cap for a radiator, it is shown in FIGS. 1 and 2 as one component of a coolant recovery system for an automotive vehicle. The coolant recovery system includes a radiator 12 having a filler neck 14 from which extends an overflow tube 15 which connects through hose 16 to a coolant-capturing reservoir 17. Also illustrated in FIG. 1 is an overflow tube 18 from reservoir 17, and a conduit 19 that leads from the radiator 12 to some other component of the automotive vehicle that may require circulation of coolant from the radiator 12.

The coolant recovery reservoir 17 is illustrated as a capped, hollow, generally rectangular tank, although the shape thereof is of no particular significance. The reservoir 17 receives temperature expanded coolant from the radiator 12 via overflow tube 16 that extends through reservoir cap 17*a*. The tube 16 includes an elongated siphon portion 16*a* shown in phantom in FIG. 1 extending from cap 17*a* to the bottom of the reservoir 17, to prevent introduction of air into the radiator 12 while cooled coolant is being siphoned from reservoir 17 back into radiator 12, as known in the art.

The filler neck, generally 14, includes an elongated tubular part 14*a*, and an annular, shaped, part 14*b* that is brazed or welded to tube 14*a*. The shaped part 14*b* defines an annular, flat, upstream terminus, or seat 20 that extends radially outwardly relative to tube 14*a*, and an annular downstream seat 22, below which extends a tubular stub 23. The adjacent side walls of parts 14*a* and 14*b* are pierced in a region spaced axially between seats 20 and 22, to receive the terminus of tube 15 which is brazed or welded at 24 to part 14*a*. The part 14*b* is formed to provide an annular, downturned, flange 26, outwardly of seat 20, with a lower terminal edge shaped to provide cams thereon, as known in the art, for cooperation with a twist-on cap.

The improved, vented radiator cap 10 of the present invention includes a cap head 28 for connection to the flange 26 of annularly shaped part 14*b* of the radiator filler neck 14, an upper valve disc means 30 for sealing against the upper seat 20 on filler neck part 14*b*, a selectively operable pressure vent means, generally 32, for opening a lower valve to vent pressurized steam and/or coolant to the coolant recovery container 17 prior to removal of the radiator cap 10, and automatically pressure-operable, release valve means 34, for permitting the escape of temperature expanded coolant and pressurized steam from the radiator 12.

The cap head 28 of the radiator cap 10 is of well-known construction and includes a plurality of ears, such as 36, for engagement with the cap camming flange 26 of the filler neck 14. When the cap 10 is placed atop the radiator 12 with the cap head 28 covering the opening in the filler neck 14 and the ears 36 engaging the camming flange 26, twist-on rotation of the cap 10 will operate to firmly seat said cap 10 on the filler neck part 14*b*.

The upper valve disc means 30 comprises an annular, upper spring disc 38 having a central aperture 40 therethrough, and an annular, coaxially positioned, resilient gasket 42, below disc 38 and having a central aperture 44 therethrough, and being of a size to sealingly engage seat 20 to form a seal therewith that provides a seal against leakage of temperature-expanded coolant, and air when siphoning, therepast. The diameter of the central aperture 44 through the resilient gasket 42 is shown greater than the diameter of the central aperture 40 through the spring disc 38. The upper valve disc means 30 is operatively associated with the cap head 28, so that when cap head 28 is secured to the camming flange 26 of the filler neck, the spring disc 38 is biased axially toward seat 20 to resiliently force gasket 42 into sealing relation with seat 20.

The selectively operable steam vent means 32 includes an axially elongated annular body 46 that is secured to the cap head 28, an elongated vent pin 78 that reciprocates through the axial bore of annular body 46, and lower vent valve means 34. A handle 90 is pivotally connected to vent pin 78.

The axially, elongated, annular body 46 has a stepped, through-bore shaped to define an upper, small diameter portion 45 and a lower, larger diameter portion 47. The upper end 48 of the annular body 46 is crimped as at 50 so as to secure said annular body 46 to a lip 52 of the cap head 28 and to the inner edge of the upper annular spring disc 38. The opposite, or lower end 49 of said annular body 46 is shaped to provide thereon an outwardly extending retainer flange 54. An elongated central portion 60 extends between the upper body end 48 and said retainer flange 54 on the annular body 46.

A coolant-control valve means 56 is provided by a generally annular, downwardly facing, bell-shaped member that is slidably positioned on the exterior, central portion 60 of the annular body 46 that is above the retainer 54. The coolant-control valve means 56 provides thereon an upper end 61 of a diameter less than the diameter of the enlarged retainer flange 54, so that body 56 cannot slide past the lower end 49 of the annular body 46. The central opening defined in said upper end 61 of valve means body 56 is hexagonally shaped, as best seen in FIG. 3, so as to establish flow spaces through which liquid flow, illustrated by arrows A in FIG. 3, will move when said body 56 is moved upwardly away from its normal seating position abutting retainer flange 54 of annular body 46. The flow spaces are defined between the circular exterior of central portion 60 of body 46 and the corners 51 of the hexagonally-shaped opening in valve body 56.

A compression coil spring 62 surrounds the annular body 46 in spaced relation thereto and is axially captured between spring disc 38 and a shoulder formed on valve body 56 so as to serve to normally bias the coolant-control valve means 56 in a downward direction, i.e., away from the cap head 28 and toward said retainer flange 54 which serves as an abutment for valve body 56. The inner diameter of the annular resilient gasket 42 clears the outer diameter of the coil spring means 62 so that gasket 42 is not engaged by coil spring 62.

The reciprocating vent pin 78 is elongated to extend coaxially through central bores 45 and 47 of the annular body 46, and to extend axially outwardly above cap head 28 and below the lower extent of body 46. The vent pin 78 is shaped to provide three axially extending portions. The lowermost end portion is of greatest diameter and provides a valve engaging head 80. The elongated upper end portion 81 is of smallest diameter and carries, adjacent its uppermost end, a pivot pin, or rivet, 81*a*, to which handle 90 connects. The intermediate portion 83 is of a diameter less than that of the valve engaging head 80 but greater than that of the upper end portion 81. The diameter of the valve engaging head 80 is substantially greater than the diameter of the lower bore 47 of the annular body 46. The diameter of the intermediate portion 83 of the vent pin 78 is only slightly less than the diameter of the surrounding bore 47 of the annular body 46 to aid in defining the elongated capturing pocket 84 for O-ring 86. The diameter of upper pin portion 81 is considerably less than the diameter of the bore 47 of the annular body 46 to form an enlarged, annular, axially elongated space, or pocket, 84 therebetween. The space 84 is of lesser axial length than the length of the downstream bore 47 of the annular body 46. The diameter of the elongated upper end 81 of the vent pin 78 is slightly less than the diameter of the surrounding upsteam bore 45 in annular body 46, to permit reciprocation of said vent pin 78 therein but again to provide a very limited dimension spacing therebetween. The axially spaced portions of the vent pin 78, lying closely adjacent to the respective bores 47 and 45 of the annular body 46, provide restricted annular passageways adjacent both ends of the elongated, relatively enlarged, space 84.

An O-ring 86 is carried on the upper, small diameter, end portion 81 of the vent pin 78, within the downstream bore 47 of the annular body 46, so as to be positioned in space 84 in fluid-tight, and essentially air tight, sealing relation with both the vent pin 78 and the lower bore 47 of body 46. The O-ring 86 effects a rolling seal in the space 84 as said vent pin 78 is reciprocated, thereby preventing leakage of liquid or gas between the vent pin 78 and the annular body 46. The restricted passageways above and below the space 84, defined between pin 78 and body 46, provide restrictions that reduce total pressure applied to O-ring 86, permitting the O-ring to provide good sealing in the space 84.

A lower spring 88 is positioned between the lower terminus of body 46 and the valve engaging head 80 of the vent pin 78 and operates to normally bias the vent pin 78 in a downward direction. The spring 88 is a frusto-conical, helical spring having at one end a maximum diameter, when compressed, that is no greater than the outer diameter of the retainer flange 54 of the annular body 46, with said spring 88 having, at its other end, a minimum inner diameter not less than the diameter of portion 83 of vent pin 78 and not greater than the diameter of the head of vent pin 78. Preferably the spring 88 lies substantially in a plane when fully compressed as seen in FIG. 2.

The handle 90 provides an elongated lever pivotably connected to one end 92 to the upper end 81 of vent pin 78. Handle 90 has a tang 96 which projects through an aperture in cap head 28 which, as a safety feature, interferes with movement of cap 10 until handle 90 has been raised, as is known in the art. The handle 90 adjacent said one end 92 is shaped to provide a cam portion 94 which normally abuts member 95 in an over-center position to maintain said vent pin 78 in an inoperative position, illustrated in FIG. 2, wherein the spring 88 is compressed and potentialized. The cam portion can be selectively moved out of its over-center position by raising handle 90 to a cap-release position, thereby permitting the potentialized spring 88 to move the vent pin 78 in a downward direction to engage and depress an actuating stem 64 of the vent valve means 34 to permit the release of pressurized steam and/or coolant in the radiator 12. After the radiator 12 has been vented of pressurized steam and/or coolant, it is safe for a person to remove cap 10.

The coolant-control valve means, or body, 56 is provided at its lower end with an out-turned flange **56*a* to which is connected a sheet metal disc part 74. The force of the coil spring 62 thereby operates to bias disc part 74 downwardly. A resilient disc 75 is positioned against the downwardly facing side of disc part 74 and is of a size to engage and sealingly seat against lower seat 22 on filler neck part 14*b***.

The vent valve means 34 includes the actuating stem 64, a frusto-conical spring 72, a ferrule 76 and an annular disc 66 positioned below resilient disc 75. The size of the parts is such that when the radiator cap 10 is twisted to its connected position on the radiator filler neck 14, the annular resilient disc 75 will be sealingly pressed against the lower seat 22 of the radiator filler neck part **14*b***.

The axially-extending, generally cylindrical, actuating stem 64 of the vent valve means 34 has its lower end crimped onto the annular valve disc 66 which normally is in sealing relation with resilient disc 75. The upper end of the actuating stem 64 is radially enlarged to form a stem head 68 against which a frusto-conical spring 72 abuts. As noted above, the actuating stem 64 will be moved downwardly against the bias of spring 72, when the handle 90 is pivoted, to permit the vent pin 78 to move downwardly to contact and depress said stem 64. The disc 66 is normally biased upwardly by spring 72, so that offset annular portion 67 of said disc 66 contacts and seals against the underside of resilient disc 75.

The disc part 74 is clamped to resilient disc 75 at their radial inner edges by ferrule 76, through which the actuating stem 64 extends. The diameter of the actuating stem 64 is substantially less than the inner diameter of the ferrule 76 to provide a flow path for gas and liquid therethrough.

The actuating stem 64 of the vent valve means 34 extends axially upwardly of resilient disc 75 and disc part 74 but terminates at a point spaced below the vent pin's flange 80, so as to be normally inaccessible when the radiator cap is used in its normal and intended manner.

THE OPERATION

With the radiator cap 10 of the present invention operatively positioned on the filler neck 14 of the radiator 12 of an automotive vehicle equipped with a coolant recovery reservoir 17, the upper annular resilient gasket 42 is pressure seated on the upper seat 20 of said radiator filler neck tube **14*a*. The upper seat 20** and the resilient gasket represent primary sealing elements which retain the coolant within the recovery system.

When the automotive vehicle is operated, the coolant in the radiator 12 becomes heated and the pressure builds up until it reaches a point where the force of the coolant, or gas against the underside of annular disc 75 forces the disc 75 off its seat 22 and permits the coolant from the radiator 12 to flow around disc 75 into the lateral overflow tube 15 in the radiator filler neck 14 and finally via overflow tube 15 into the coolant recovery reservoir 17.

When the engine cools, a partial vacuum is created in the radiator and communicated to filler neck 14. The vacuum opens the vent valve means 34 against the resistance of the stem-biasing coil spring 72 and the coolant is sucked from the coolant recovery reservoir 17, through the overflow tube 15, into the filler neck 14, through the hexagonally-shaped opening in the coolant-control valve means 56, past the open vent valve means 34 and into the radiator 12. The siphoned coolant path is depicted in FIG. 2 by the series of arrows marked B. When the pressures internally and externally of the radiator 12 are substantially equal, the vent valve means 34 returns to its normally closed position.

In order to accomplish the recovery of coolant from the coolant recovery reservoir 17, it is imperative that there be a minimum of leakage from the top of the filler neck 14, or the vacuum siphoning action could not occur. The positioning of the O-ring seal 86 in the enlarged, O-ring capturing space 84, and the spring bias of the spring 38 forcing the annular resilient gasket 42 against the upper seat 20 operate to normally restrict the ingestion of air which would otherwise operate to destroy the siphoning action.

At such times that servicing of the radiator 12 is necessary, the handle 90 of the vented radiator cap 10 is lifted, and the vent pin is pushed downwardly by the potentialized stem-biasing frusto-conical spring 88. The valve-engaging head 80 of the vent pin 78 moves downwardly to engage the stem head 68 and depress the actuating stem 64 of the vent valve means 34, thereby causing the vent valve means 34 to open. The pressurized coolant and/or steam is then discharged into the coolant recovery reservoir 17 by following the same path as described above for the siphoned coolant, and steam can then escape to atmosphere through overflow tube 18 until a safe pressure condition is achieved in radiator 12.

The serviceman is now able to twist off the radiator cap 10 from filler neck 14.

While one form of the invention has been described, it will be understood that the invention may be utilized in other forms and environments, so that the purpose of the appended claims is to cover all such forms of devices not disclosed but which embody the invention disclosed herein.

What is claimed and desired to be secured by Letters Patent of the United States is:

1. An improved radiator cap for use with a coolant recovery system that includes a filler neck provided with spaced upper and lower valve seats and a coolant flow passageway communicating from a reservoir through a side wall of the filler neck in the region between said spaced valve seats; said radiator cap comprising spaced upper seal means and lower seal means adapted for respective sealing against said upper and lower valve seats, the upper seal means being constructed to prevent loss of temperature-expanded coolant and ingestion of atmospheric air therepast; the lower seal means carrying an openable vent valve through which hot gas and temperature-expanded coolant may be selectively vented to said coolant flow passageway and through which reduced temperature coolant may be siphoned back into the radiator; and means for selectively actuating said vent valve to open position including an elongated annular body, a vent pin arranged for reciprocable movement in the bore of said elongated annular body, axially spaced portions of the annular body lying closely adjacent said vent pin to define therebetween axially spaced, restricted annular passageways but with an enlarged, axially elongated, annular passageway located between said restricted annular passageways, and an O-ring seal carried on said vent pin and effecting a rolling seal between said vent pin and the elongated annular body within said enlarged, axially elongated, annular space to prevent leakage of gas and liquid between the vent pin and the annular body.

2. An improved radiator cap for use with a radiator for an automotive vehicle that is equipped with a coolant recovery system, in which temperature-expanded coolant will move from said radiator to a coolant reservoir and reduced-temperature coolant is restored from the reservoir back to the radiator, the radiator having a filler neck defining thereon an upper seat, a camming flange adjacent said upper seat, a lower seat that is spaced below said upper seat and is adapted to have a coolant-control valve means spring biased thereagainst and past which the temperature-expanded liquid coolant will pass to said reservoir, and lateral aperture means, arranged for communicating with said reservoir, provided in the portion of the filler neck located between said upper and lower seats; said radiator cap comprising, in combination:

a cap head, adapted for twist-on type connection with the camming flange of a radiator filler neck, and upper valve disc means operatively associated with said cap head and adapted when the cap head is secured to said camming flange to be spring biased toward the upper seat of the radiator filler neck, said valve disc means including an upper spring disc and an annular resilient gasket engaged by said spring disc to be sealingly biased against said upper seat of the radiator filler neck to provide a seal against leakage of temperature-expanded liquid coolant therepast and also against entry or siphoning of atmospheric air therepast;

an elongated annular body secured adjacent one end thereof to a central portion of the cap head and spring disc, the other end of said annular body having a retainer defined thereon, a coolant-control valve means slidably positioned on the central portion of said annular body above said retainer, coil spring means surrounding said elongated body and normally biasing said coolant-control valve means in the direction away from the cap head and toward said retainer; the coolant-control valve means including a downwardly facing annular resilient disc, and vent valve means operatively associated with the resilient disc and providing an actuating stem thereof extending axially upwardly thereof, but terminating at a point spaced below the other end of said annular body so as to be inaccessible when the radiator cap is used in its normal and intended manner, a selectively actuatable reciprocating vent pin extending coaxially through said elongated annular body and having an enlarged valve engaging head at the lower end thereof of greater diameter than the diameter of the adjacent central aperture of said annular body, the size and shape of the vent pin and of the bore of the annular body being selected and arranged to provide therebetween an axially elongated, seal space, therebetween, an O-ring carried on said vent pin and positioned within said seal space in fluid-tight sealing relation with both the vent pin and the inner bore of the annular body, and a lower spring means positioned between the lower terminus of the annular body and the valve engaging head of the vent pin for normally biasing the vent pin in a downward direction;

a handle operatively associated with said vent pin and constructed so that when in one position it maintains the vent pin in an upper, inoperative, position with said lower spring means potentialized, and movement of the handle to another position away from said one position permitting reciprocation of the vent pin and permitting the potentialized lower spring means to automatically move the vent pin to engage and depress the actuating stem of the vent valve means to permit release of steam at superatmospheric pressure.

3. A construction as in claim 2, wherein said retainer at the other end of said annular body is an outwardly extending retainer flange, and the lower spring means is a frusto-conical helical spring having a maximum diameter, when compressed, no greater than the outer diameter of the retainer flange at the lower end of the annular body, and a minimum diameter less than the diameter of the valve engaging head on the vent pin.

4. A construction as in claim 2, wherein the seal space between the vent pin and its surrounding annular body is enlarged to a size in which said O-ring may roll while maintaining its seal with the vent pin and annular body, as the vent pin is reciprocated between said one position and said inoperative position.

5. An improved radiator cap for use with a filler neck that is provided with spaced upper and lower valve seats; said radiator cap comprising an upper seal means and a lower seal means adapted respectively for seating on upper and lower valve seats of a filler neck; the upper seal means being constructed to prevent, when seated against an upper valve seat, loss of temperature-expanded coolant, moving from the space between said upper and lower seal means to a region outwardly of the cap, and to prevent ingestion of atmospheric air from the region outwardly of the cap to the space between said upper and lower seal means; the lower seal means being constructed to be separated from a lower valve seat under pressure of temperature-expanded coolant tending to move coolant from its source past said lower seal means, said lower seal means including vacuum-responsive valve means thereon for permitting movement of coolant through said lower seal means under pressure conditions being developed in the coolant; means including a selectively manually actuatable handle on the exterior of the cap connected to a slidable vent pin for selectively opening said vacuum-responsive valve means and to permit safety venting of pressure conditions in the coolant; an annular body upon which the lower seal means is slidably mounted, the vent pin being slidable in the central bore of the annular body, the annular body and vent pin being constructed and arranged to define therebetween an axially elongated, annular space, and an O-ring seal on the vent pin located in the annular space and operative to provide a seal preventing flow of pressurized coolant and gas therepast and to prevent aspiration of atmospheric air therepast.

* * * * *